United States Patent [19]

Kasai

[11] Patent Number: 4,774,744

[45] Date of Patent: Oct. 4, 1988

[54] SNAP BUCKLE

[75] Inventor: Kazumi Kasai, Namerikawa, Japan

[73] Assignee: Yoshida Kogyo K. K., Tokyo, Japan

[21] Appl. No.: 136,520

[22] Filed: Dec. 21, 1987

Related U.S. Application Data

[63] Continuation of Ser. No. 049,439, May 14, 1987, abandoned.

[30] Foreign Application Priority Data

May 15, 1986 [JP] Japan ..... 61-73101

[51] Int. Cl.[4] ..... A44B 11/25

[52] U.S. Cl. ..... 24/625; 24/664

[58] Field of Search ..... 24/625, 615, 184, 185, 24/614, 618, 664, 665, 662, 663

[56] References Cited

U.S. PATENT DOCUMENTS

| | | | |
|---|---|---|---|
| 3,120,971 | 2/1964 | Bengtsson | 24/625 |
| 3,626,556 | 12/1971 | Struck | 24/665 |
| 4,324,024 | 4/1982 | Fontana . | |
| 4,425,689 | 1/1984 | Fildan | 24/664 |
| 4,443,916 | 4/1984 | Tiemann | 24/664 |
| 4,577,377 | 3/1986 | Kasai | 24/625 |
| 4,631,787 | 12/1986 | Kasai | 24/615 |
| 4,672,725 | 6/1987 | Kasai | 24/625 |

FOREIGN PATENT DOCUMENTS

| | | |
|---|---|---|
| 0204250 | 12/1986 | European Pat. Off. . |
| 2511582 | 4/1985 | France . |
| 60-31809 | 3/1985 | Japan . |
| 319515 | 9/1929 | United Kingdom . |

*Primary Examiner*—Victor N. Sakran

*Attorney, Agent, or Firm*—Hill, Van Santen, Steadman & Simpson

[57] ABSTRACT

In a buckle comprising male and female members, releasably couplable to each other in snap action, the female member has in its side wall a pair of side walls a pair of side slits, respectively, in which a pair of resilient arms of the female member extends. The female member also has in its bottom wall a pair of transversely spaced holes into which a projection on the respective arm extends. The movement of each arm in a direction perpendicular to the general plane of the female member is restricted within the width of the respective slit, while the transverse movement of each arm is restricted within the width of the respective hole.

3 Claims, 4 Drawing Sheets

SNAP BUCKLE

This is a continuation of application Ser. No. 049,439, filed May 14, 1987, now abandoned.

BACKGROUND OF THE INVENTION

1. Field of the Invention

The present invention relates to a buckle for fastening a closure flap of a bag, a rucksack or the like, and also for fastening straps, belts or suspenders of a shoe, a boot, trousers, a skirt or the like.

2. Description of the Prior Art

Japanese Utility Model Laid-Open Publication No. 60-31809 discloses a buckle for fastening belts of a shoe which buckle comprises, as shown in FIGS. 4A and 4B of the accompanying drawings, interlocking male and female members A, B. The male member A has on its rear surface a pair of resilient legs C, C, each having on its outer side a stepped portion which is engageable with the edge D of an aperture in the female member B as the male member A is pressed against the female member B so as to force the legs C, C into the aperture from the front side of the female member B in a snap action. The female member B has a pair of resilient arms E, E having a pair of inwardly directed pushing portions F, F. When the two arms E, E are pressed toward each other, the pusher portions F, F pushes the legs C, C so as to resiliently bend the same inwardly, thereby bringing the stepped portions out of engagement with the edge D of the aperture.

Such prior buckle is disadvantageous in that since there is no means for protecting the arms E, E, where the extent to which each of the arms E is movable laterally and perpendicularly to the general plane of the buckle is more than necessary. Further, such non-protected arms E, E tend to be broken when undue pulling forces are exerted on the arms, for example when a garment is caught by the arms.

SUMMARY OF THE INVENTION

It is therefore an object of the present invention to provide a buckle in which male and female members are coupled together by forcing resilient legs of the male member into a central aperture in the female member from the front side of the female member, and in which a pair of resilient arms of a female member is kept from moving beyond a constant necessary extent and is hence prevented from being broken or otherwise damaged.

According to the present invention, a female member of a buckle has a pair of resilient arms disposed in a pair of side slits, respectively, of the female member and having a pair of grips each projecting outwardly of the respective side slits. Each of the arms also has a projection extending from its free end perpendicularly to the general plane of the female member and projecting into a respective one of a pair of restriction holes of a predetermined size in a bottom plate of the female member. The movements of each projection and hence of the arm is limited by the respective slit and the respective hole.

Many other objects, advantages and additional features of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 3A:
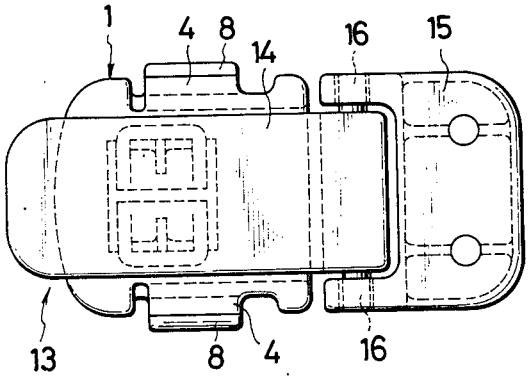
FIG. 3A is a plan view of the buckle, showing the male and female members in a coupled posture.
Figure 3B:
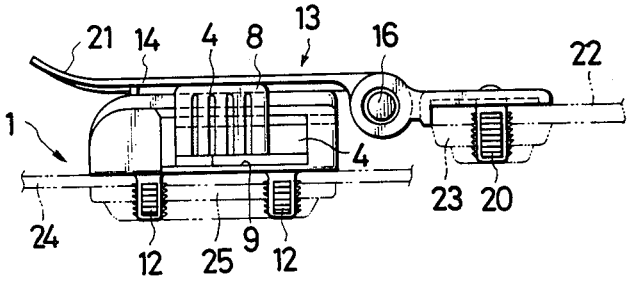
FIG. 3B is a side elevational view of FIG. 3A.
Figure 3C:
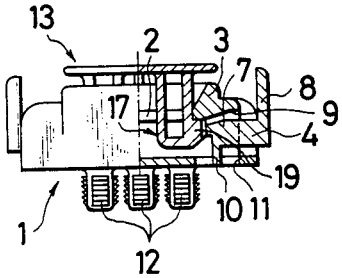
FIG. 3C is a left end elevational view, partly in cross section, of FIG. 3A.
Figure 4A:
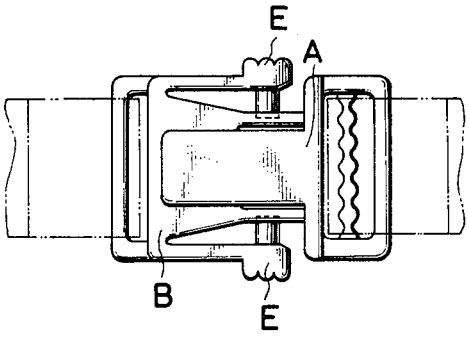
FIG. 4A PRIOR ART
FIG. 4A is a plan view of a buckle according to a prior art, showing male and female members in a coupled posture.
Figure 4B:
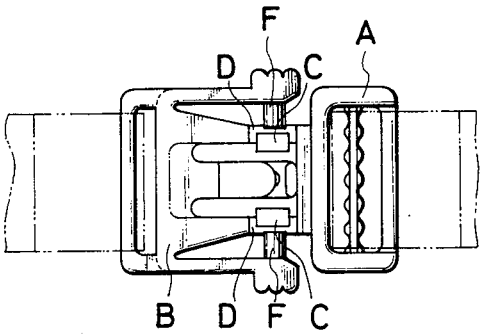
FIG. 4B PRIOR ART
FIG. 4B is a bottom view of FIG. 4A.

The principle of the present invention is particularly useful when embodied in a buckle such as shown in FIGS. 3A through 3C.

The buckle comprises a male member (FIGS. 2A through 2D) 13 and a female member (FIGS. 1A through 1E) 1. Each of the male and female members 13, 1 is molded of a synthetic resin such as polyacetal, nylon or polypropylene.

Figure 1A:
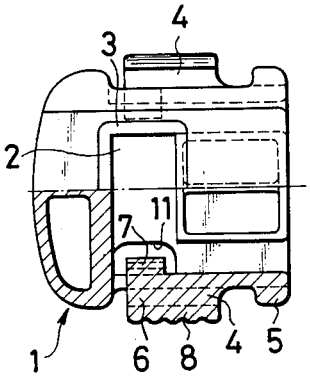
FIG. 1A is a plan view, partly in cross section, of a female member of a buckle embodying the present invention.
Figure 1B:
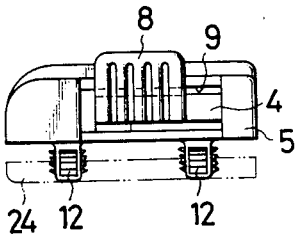
FIG. 1B is a side elevational view of FIG. 1A.
Figure 1C:
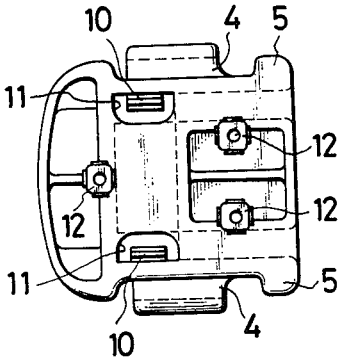
FIG. 1C is a bottom view of FIG. 1A.
Figure 1D:
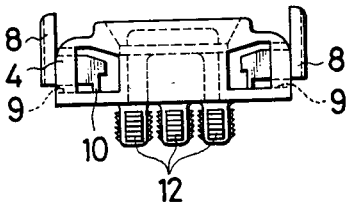
FIG. 1D is a right end elevational view of FIG. 1A.
Figure 1E:
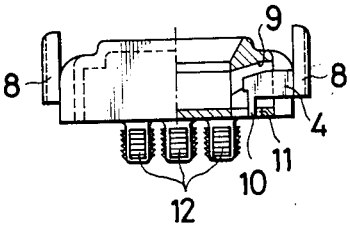
FIG. 1E is a left end elevational view of FIG. 1A.

As shown in FIGS. 1A through 1E, the female member 1 is generally in the form of a case having in its top wall a central aperture 2, in its side walls a pair of side slits 9, 9, and in its bottom wall a pair of transversely spaced restriction holes 11, 11. The female member 1 also has a pair of resilient arms 4, 4 each extending from a base 5 near one end (right end in FIGS. 1A through 1C) of the female member 1 into the respective side slit 9. As shown in FIGS. 1A and 1C, each arm 4 is restricted or narrowed in width at its midportion and has on its free end 6 a grip 8 projecting outwardly of the respective side slit 9. The restricted midportion of the arm 4 is resiliently bendable when the grip 8 is pushed inwardly for a purpose described below.

Each arm 4 also has on its free end 6 an inwardly extending pusher portion 7 for a purpose described below. A projection 10 extends from the pusher portion 7 perpendicularly to the general plane of the female member 1 into the respective hole 11. On the bottom side of the female member 1 there are three supports 12, 12, 12 adapted to be secured to a strap, a belt, a suspender or the like (hereinafter referred to as "strap") 24.

Most important, the extent to which each arm 4 is movable perpendicularly to the general plane of the female member 1 is restricted within the width of the respective side slit 9. The extent to which the projection 10 of each arm 4 is movable laterally or transversely of the female member 1 is restricted within the width of the respective hole 11; that is, the lateral movement of each arm 4 is restricted within the width of the respective hole 11.

Figure 2A:
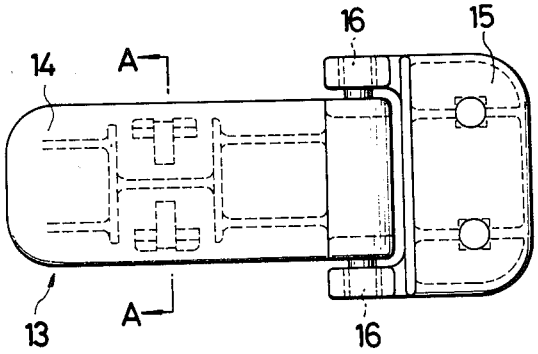
FIG. 2A is a plan view of a male member of the buckle.
Figure 2B:
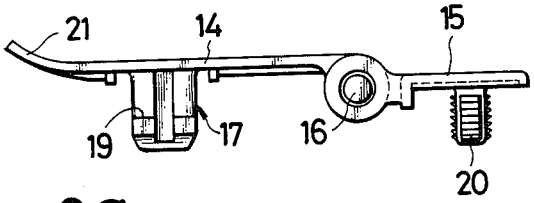
FIG. 2B is a side elevational view of FIG. 2A.
Figure 2C:
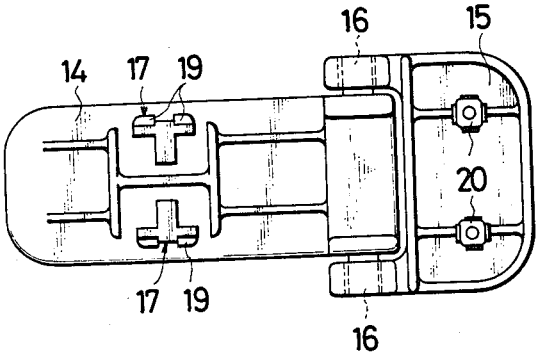
FIG. 2C is a bottom view of FIG. 2A.

As shown in FIGS. 2A through 2C, the female member 1 includes an attachment 15 and a tongue-shaped presser 14 pivotally mounted on the attachment 15 by means of pins 16, 16. The attachment 15 has on its bottom side a pair of supports 20, 20 adapted to be secured to another strap 22 (FIG. 3B).

Figure 2D:
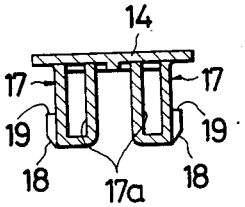
FIG. 2D is a cross-sectional view taken along line A—A of FIG. 2A.

The presser 14 has on its bottom side a pair of resilient legs 17, 17 each having on its outer side a pair of stepped portions 19, 19 (FIGS. 2B through 2D). The stepped portions 19, 19, 19, 19 are resiliently engageable with the edge 3 of the central aperture 11 in the female member 1 as the legs 17, 17 are forced into the central aperture 11 (as shown in FIGS. 3A through 3C) in a snap action by pressing the presser 14 against the front side of the male member 13. Each leg 17 also has a pair of sloping surfaces 18, 18 (FIG. 2D) contiguous to the respective stepped portions 17, 17 which surfaces in inserting the leg 17 smoothly into the central aperture 11. Each leg 17 additionally has a slit 17*a* (FIG. 2D) which causes an increased degree of resilience of the leg 17.

As shown in FIG. 3B, the removal of the straps 22, 24 from the supports 20 of the male member 13 and from the supports 12 of the female member 1 is prevented by a pair of retainer plates 23, 25, respectively.

With the male and female members 13, 1 in a coupled posture (FIGS. 3A through 3C), when the opposed arms 4, 4 are pressed inwardly toward each other, the pusher portions 7, 7 push the legs 17, 17 so as to resiliently bend the latter inwardly, thereby bringing the stepped portions 19, 19, 19, 19 out of engagement with the edge 3 of the central aperture 2. At that time, the extent to which each arm 4 is moved perpendicularly to the general plane of the female member 1 and hence of the buckle, is restricted within the width (height in FIGS. 3B and 3C) of the respective side slit 9. Further, the extent to which the projection 10 of each arm 4 is moved laterally or transversely of the female member 1, is restricted within the width of the respective hole 11; that is, the lateral movement of each arm 4 is restricted within the width of the respective hole 11.

With the stepped portions 19 of the two legs 17, 17 out of engagement with the edge 3 of the central aperture 2, as the presser 14 is pivotally moved clockwise in FIG. 3B about the aligned pins 16 by pulling the distal end 21 of the presser 14 upwardly, the two legs 17, 17 are released from the central aperture 2 in the female member 1. Thus the male and female members 13, 1 have been uncoupled.

According to the present invention, partly because the movement of each arm 4 in a direction perpendicular to the general plane of the female member 1 is restricted within the width of the respective side slit 9, and partly because the lateral or transverse movement of each arm 4 is restricted within the width of the respective hole 11, the arm 4 is prevented from being broken or otherwise damaged even when undue stress is exerted on the arm 4.

Although various minor modifications may be suggested by those versed in the art, it should be understood that I wish to embody within the scope of the patent granted hereon, all such embodiments as reasonably and properly come within the scope of my contribution to the art.

What is claimed is:

1. A buckle comprising:

(a) a female member in the form of a case having in its top wall a central aperture, said female member having a pair of transversely spaced resilient arms each extending from a base near one end of said female member;

(b) a male member having a tongue-shaped presser having on its bottom side a pair of resilient legs each having on its outer side at least one stepped portion engageable with an edge of said central aperture in said female member as said legs are forced into said central aperture in a snap action; and (c) said female member further having in its side walls a pair of side slits and in its bottom wall a pair of transversely spaced restriction holes, each of said arms extending into the respective side slit and having on its free end an inwardly extending pusher portion for pushing the respective leg of said male member, each of said arms also having a projection extending into the respective hole of said bottom wall.

2. A buckle according to claim 1, each of said legs having a slit.

3. A buckle according to claim 1, wherein said male member also includes an attachment, said tongue-shaped presser being pivotally mounted on said attachment.

* * * * *